United States Patent [19]

Schwelm

[11] Patent Number: 4,711,267

[45] Date of Patent: Dec. 8, 1987

[54] HYDRAULIC CONTROL BLOCK

[75] Inventor: Hans Schwelm, Howald, Fed. Rep. of Germany

[73] Assignee: Hydrolux S.a.r.l., Luxembourg

[21] Appl. No.: 833,485

[22] Filed: Feb. 12, 1986

[30] Foreign Application Priority Data

Feb. 13, 1985 [LU] Luxembourg ..... 85774

[51] Int. Cl.[4] ..... F15B 13/043

[52] U.S. Cl. ..... 137/596.15; 137/596.16; 137/884

[58] Field of Search ..... 91/454; 137/596.14, 137/596.15, 596.16, 884

[56] References Cited

U.S. PATENT DOCUMENTS

| | | | |
|---|---|---|---|
| 3,151,455 | 10/1964 | Tennis | 91/454 |
| 3,556,144 | 1/1971 | Bickers et al. | 137/596.15 |
| 4,170,214 | 10/1979 | Gill et al. | 137/884 X |
| 4,340,086 | 7/1982 | Hemm et al. | 137/554 |
| 4,453,565 | 6/1984 | Neff | 137/884 X |
| 4,476,893 | 10/1984 | Schwelm | 251/30.01 X |
| 4,478,245 | 10/1984 | Bender | 137/554 |
| 4,535,809 | 8/1985 | Andersson | 137/596.14 |
| 4,565,221 | 1/1986 | Yoshida et al. | 60/484 X |

FOREIGN PATENT DOCUMENTS

| | | | |
|---|---|---|---|
| 180877 | 10/1983 | Japan | 137/596.15 |

*Primary Examiner*—Gerald A. Michalsky

*Attorney, Agent, or Firm*—Mason, Fenwick & Lawrence

[57] ABSTRACT

The control block consists of four seat valves arranged in pairs above one another and opposite one another in two planes parallel to the base surface of the control block, the valves located diagonally opposite one another being controllable in pairs via a pilot valve. The logical combination of the invididual elements makes it possible to construct a compact, space-saving and handy control unit with a sealing surface arranged according to the customary standard pattern.

4 Claims, 3 Drawing Figures

HYDRAULIC CONTROL BLOCK

The present invention relates to a hydraulic control block for hydraulic units, especially for controlling double-acting hydraulic cylinders.

Conventional controls have a 4/3-way slide valve as their basic element, for controlling the hydraulic fluid in the two working lines alternately in one direction or the other. To give this basic element the necessary functions according to the particular intended use, it has to be combined with additional valves. These additional valves are a pressure-reducing valve, a one-way restrictor and a non-return valve. Depending on the working pressure, a pilot control element consisting of a 4-way slide valve also has to be added.

These 4 or 5 elements are assembled in plate form in a sandwich construction in accordance with European or American standards, the hydraulic fluid flowing through each element continuously during operation.

The disadvantage of this arrangement is that it has a relatively large number of movable wearing parts and causes high pressure losses. Moreover, each element must have two sealing surfaces, and the necessary O-ring gaskets have to be provided for each sealing surface, but this means that there is relatively great danger of leakage.

The object on which the present invention is based is to provide a novel control block which will avoid the above disadvantages and which, moreover, will also have additional advantages.

According to the invention, this object is achieved by means of a control block which has the features mentioned in the main claim. Further embodiments are to be found in the sub-claims.

According to the invention, the basic element consisting of the directional slide valve has been replaced by four simple seat valves resembling one another. The separate non-return valve and the one-way restrictor are omitted, because their functions are also performed by the seat valves. In the control block according to the invention, the through-flow distance is, accordingly, significantly less, and this in turn means a lower pressure loss.

The bores for the seat valves and the connecting lines are provided in a compact housing block, so there is no need for the sealing surfaces between the individual control elements. Only one sealing surface remains, and this allows the control block to be mounted directly on the consumer. Furthermore, this sealing surface has the connections in the form of the customary standard pattern, so that the control block according to the invention can be interchanged with known elements in a simple way.

The advantage of seat valves in relation to slide valves is also that they have fewer wearing parts and that they are more robust and less sensitive to dirt.

In summary, it may be stated that the control block according to the invention has a higher loading capacity, a higher performance, a longer service life and a faster switching time.

The invention is described in detail below by means of an exemplary embodiment, with reference to the attached drawings in which.

Figure 1:
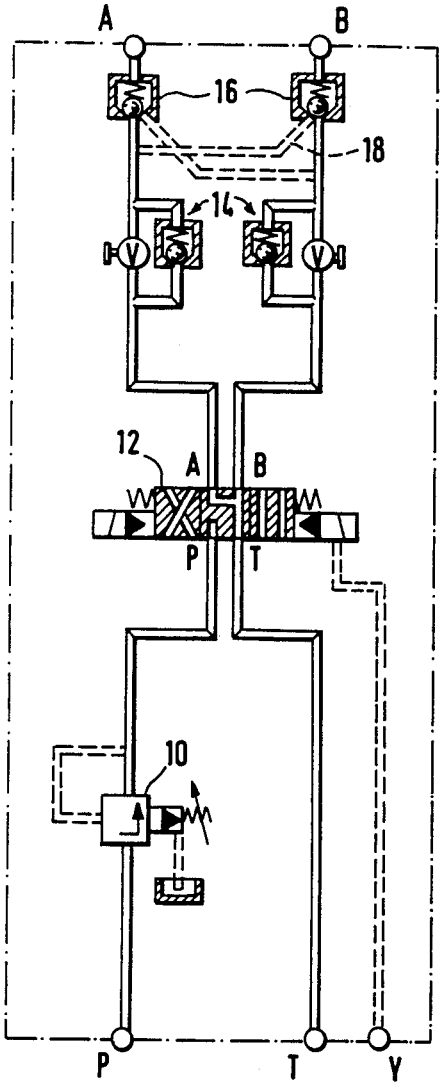
FIG. 1 shows the circuit diagram of a conventional control.

In FIG. 1, the five connections are designated in the usual way, that is to say the pump connection by P, the tank line by T, the control line by Y and the two working lines by A and B respectively.

In the throughflow direction, the arrangement has a pressure-reducing valve 10 which, in the design illustrated, is adjustable. The hydraulic fluid subsequently arrives at the connection P of a 4/3-way valve slide 12 which is controlled magnetically. In the illustration shown, the passage is blocked. When the slide 12 is pressed to the left, the outlet A is connected to the pump line P, and the hydraulic oil passes via an adjustable one-way restrictor 14 and a controlled non-return valve 16 into the working line A. The dot-and-dash line 18 indicates that the pressure in the line A opens the non-return valve 16 in the return line B, as a result of which the oil can flow through the one-way restrictor 14 and the slide 12 into the tank line T. During the return through the line B, the one-way part of the valve 14 forces the oil to flow through the restrictor.

Figure 2:
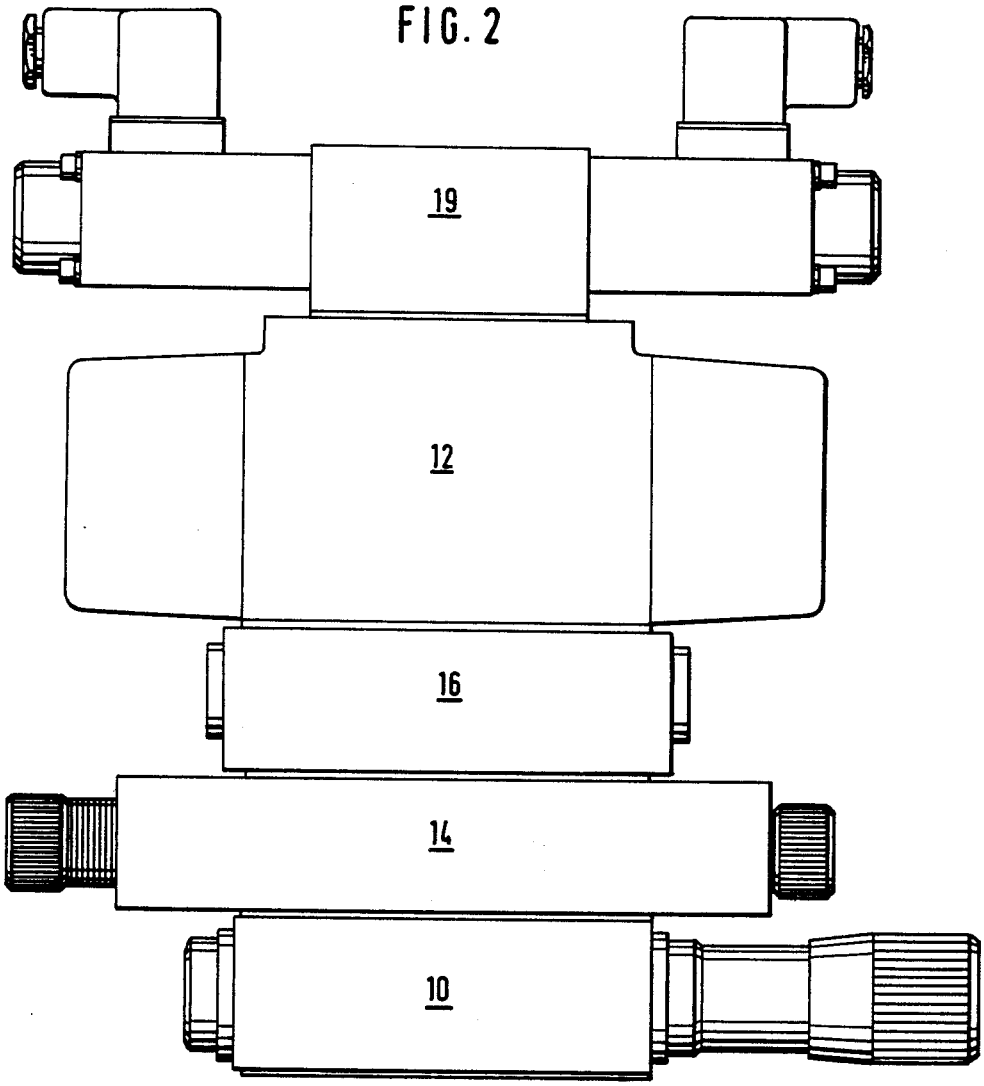
FIG. 2 shows the plate-shaped arrangement of the individual control elements of the circuit according to FIG. 1.

The spatial arrangement of the individual elements of the circuit of FIG. 1 is shown in FIG. 2, the same reference numerals being used here as in FIG. 1. As shown in FIG. 2, the individual elements are stacked on top of one another in plate form, and each element has to have two sealing surfaces with the customary standard pattern of connections. 19 denotes a pilot valve for pilot control.

Figure 3:
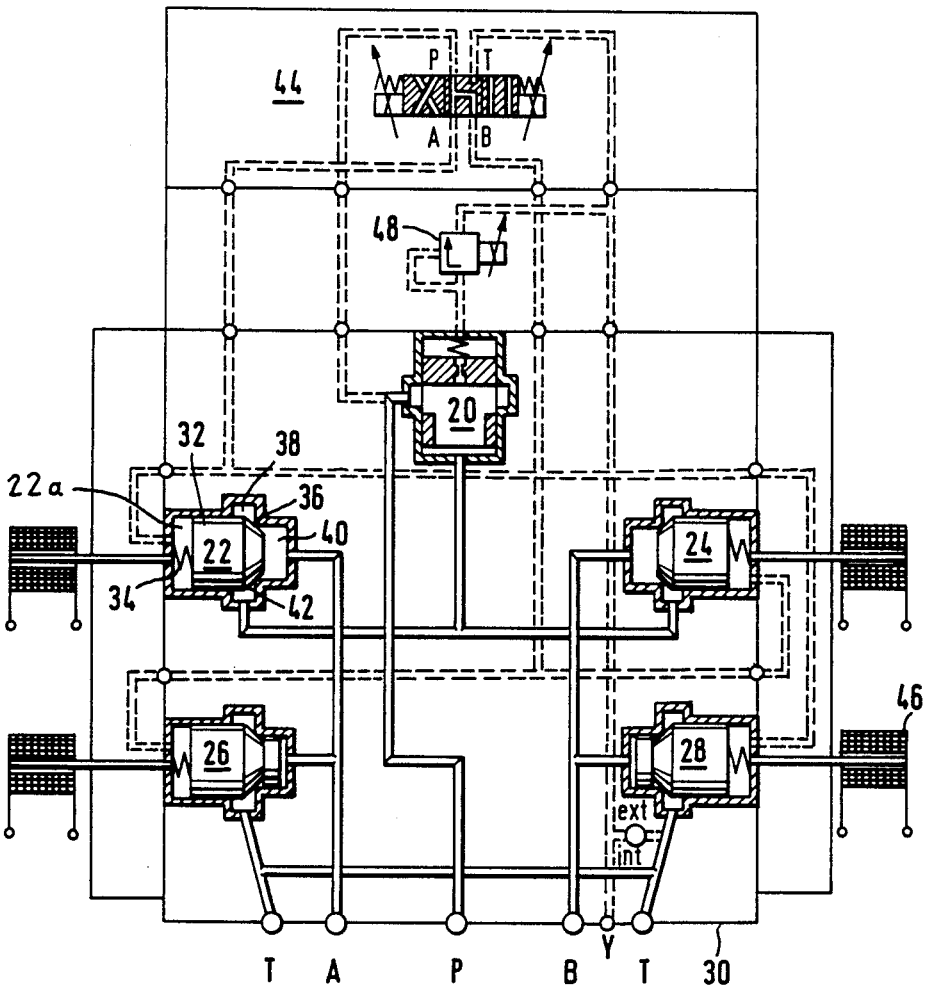
FIG. 3 shows the circuit diagram of the control according to the invention .

In the circuit diagram according to the invention, shown in FIG. 3, the oil connections are again designated by A, B, P, T and Y, as in FIG. 1.

The basic elements of the control block according to the invention are four seat valves 22, 24, 26 and 28 and a pressure-reducing valve 20. The four seat valves are arranged in pairs above one another and opposite one another in two planes parallel to the base surface 30. Each seat valve, consists, in a way known per se, of a valve piston 32 which is exposed to the pressure of a spring 34 in a cylindrical bore and which is pressed in a closing direction onto the valve seat 36 by means of the spring force. The valve seat 36 consists of the edge between an annular space 38 and a valve space 40. A conical taper of the piston 32 forms the seat surface 42 which extends from the annular space 38 into the valve space 40 and which in a closed position on the valve seat, separates the spaces 38 and 40 from one another.

The four valves 22, 24, 26 and 28 resemble one another in design and functional terms, so there is no need for a detailed description of each individual valve.

The pump line P is connected via the pressure-reducing valve 20 to the valve space of the two upper seat valves 22 and 24, whilst the annular spaces of these two valves are connected to the working lines A and B respectively. These working lines A and B are likewise connected to the valve spaces of the seat valves 26 and 28 respectively, whilst the annular spaces of these valves 26 and 28 are connected to the tank lines T.

The four seat valves 22, 24, 26 and 28 are pilot-controlled crosswise via a pilot valve 44. This pilot valve 44 consists of a known slide valve which is likewise connected to the pump line P. As can be seen in FIG. 3, the working line A of the pilot control is connected to the piston spaces of the two seat valves 22 and 28, whilst the working line B is connected to the piston spaces of the two seat valves 24 and 26. The leakage oil of the pilot valve 44 is discharged via a line Y which is connected inside or outside the control block to the tank line T. The pilot valve is controlled electromagnetically in a way known per se, but not shown.

In the position of the pilot valve, as illustrated, the pump line P is connected to the two working lines A and B of the pilot control. That is to say, the piston spaces of all four valves 22, 24, 26 and 28 are under oil pressure, and the valve pistons are retained on their seat surfaces in the closed position under the influence of this oil pressure and the spring pressure.

When the slide of the pilot valve 44 is pressed to the right, the working line A of the pilot control is "relieved" via T and Y, whilst the line B continues to remain under oil pressure and the valves 24 and 26 remain closed. When the pressure drops in the control line B, the valves 22 and 28 are now exposed only to the pressure of their springs 34 in the closing direction. On the other hand, however, the pumped oil flows via the pump line P and through the open pressure-reducing valve 20 into the annular space 38 of the valve and acts on the conical seat surface 42 of the piston 32. This piston is accordingly exposed to the force of the spring 34 in the direction of the closing position and to the force of the oil pressure in the opposite direction. The force of the spring 34 is calculated so that it is less than the force exerted by the oil pressure on the seat surface 42. This means that, in the situation described, the valve 22 is opened by means of the oil pressure counter to the force of the spring 34, and that the oil flows through the opened valve into the working line A.

The oil return takes place via the working line B, as a result of which the piston surfaces of the valves 24 and 28 are exposed to the oil pressure in the valve space. However, since the piston of the valve 24 is exposed to the oil pressure on both sides, the force of the oil pressure in the line B is not sufficient to move the piston, so that the valve 24 remains closed.

In contrast to this, in the valve 28 which is "relieved" via the pilot valve 44, the oil pressure is sufficient to overcome the spring force and shift the valve piston into the open position, with the result that the oil flows through the valve 28 into the tank line T.

In the position of the pilot valve 44, as described, the hydraulic fluid accordingly flows forward from the pump line P into the working line A and returns through the working line B into the tank line T.

When the slide of the pilot valve 44 is pressed to the left, the working line B of the pilot control is "relieved" via T and Y, whilst the line A comes under oil pressure. Accordingly, the valve 22 ise exposed to the same oil pressure on both sides. Since the surfaces of the piston 32 which are subjected to pressure are likewise of the same size in the open position, the piston 32 would be in a suspended state. However, the piston 32 is also exposed to the effect of the spring 34 and under the influence of this spring force the valve 22 closes. The same operation takes place in the valve 28, so that this valve also closes.

In contrast to this, as described above with regard to the opposite situation, the valves 24 and 26 are brought into the open position by means of the oil pressure in the annular space and in the valve space.

When the pilot valve 44 is in this position, the oil therefore flows in the opposite direction, that is to say the forward flow from the pump line P into the working line B and the return flow through the working line A into the tank line T.

There is no need to describe the spatial arrangement similar to that of FIG. 2, since the spatial arrangement corresponds to that of the circuit diagram of FIG. 3, particularly as regards the relative arrangement of the individual elements 20, 22, 24, 26, 28 and 44.

The design is extremely simple, since all the bores for the oil lines and valve elements are drilled or milled in a cubic or cuboid block. The logical and apt combination of the individual elements makes it possible to obtain a compact, space-saving and handy control unit in comparison with that of FIG. 2.

The two valves 26 and 28, which can also be called tank elements since they each regulate the return to the tank line, are preferably equipped with an adjustable stroke limiter, with the result that the opening of these two valves and therefore the throughflow of oil can be regulated.

Moreover, each of the four seat valves 22, 24, 26 and 28 is provided with a displacement sensor 46 known per se, making it possible to monitor the positions of the individual valves continuously and, is appropriate, make the control automatic.

The pressure-reducing valve is proportionally programmable via a pilot control 48. The performance of the control block can consequently be matched to the consumer.

If the control block according to the invention is compared with the known controls according to FIG. 1, it will be seen that all the functions are preserved. Pressure is reduced and regulated by means of the pressure-reducing valve 20 or its pilot control 48. The function of the non-return valves is performed by the seat valves 22, 24, whilst the seat valves 26, 28 ensure controlled throttling. The function of the 4/3-way valve 12 of FIG. 1 is performed by the combination of the four seat valves 22, 24, 26 and 28.

I claim:

1. A hydraulic control block for hydraulic units, especially for controlling double-acting hydraulic cylinders, comprising a valve housing block having a base surface and having four bores each forming a respective one of four seat valves arranged in pairs above one another and opposite one another in first and second planes parallel to the base surface of the housing block, each seat valve comprising a cylindrical bore portion defined by a respective one of said bores providing a piston space and a piston member having a cylindrical bore portion slidable in said piston space guided by and in surface contact with the cylindrical bore portion, the piston member having a conically tapered end portion and said bores each having a smaller diameter cylindrical valve space extending from an end of said piston space and defining a circular valve seat against which the tapered end portion of the piston member seats in closed position, a spring urging each piston member towards said closed position,and each bore having and annular space outwardly encircling the cylindrical bore portion adjacent the associated valve seat; the housing block having internal conduits including a pump conduit and a pressure-reducing valve connected thereto and through conduits in the housing block to the annular spaces of the pair of valve bores in said first plane, a tank conduit in said block connected to the annular spaces of the pair of valve bores in said second plane and to a pilot valve, first and second working line conduits connected to the valve spaces of each respective pair of upper and lower valve bores arranged one above another, and working line conduits cross-connected between the piston spaces of each upper valve bore of said first plane and the opposite lower valve bore of said second plane for selective connection to said pilot valve, whereby the valves located diagonally opposite one another are controllable in pairs by the pilot valve and by the pressure reducing valve.

2. A hydraulic control block as defined in claim 1, wherein connections for hydraulic fluid to the working line conduits, the pump conduit and the tank conduit are arranged in said base surface in a selected pattern.

3. A hydraulic control block as defined in claim 2, wherein each seat valve is provided with a displacement sensor.

4. A hydraulic control block as defined in claim 1, wherein each seat valve is provided with a displacement sensor.

* * * * *